US007568767B2

(12) United States Patent
Richardson

(10) Patent No.: US 7,568,767 B2
(45) Date of Patent: Aug. 4, 2009

(54) SNAP-TOGETHER PATIO BENCH

(75) Inventor: Jed Richardson, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 32 days.

(21) Appl. No.: 11/617,023

(22) Filed: Dec. 28, 2006

(65) Prior Publication Data

US 2008/0157571 A1 Jul. 3, 2008

(51) Int. Cl.
*A47C 7/00* (2006.01)

(52) U.S. Cl. ..... 297/440.1; 297/440.23

(58) Field of Classification Search ..... 297/440.14, 297/440.1, 118.1, 188.1, 440.23
See application file for complete search history.

(56) References Cited

U.S. PATENT DOCUMENTS

| | | | | |
|---|---|---|---|---|
| 3,463,546 | A | 8/1969 | Giebel | |
| 3,748,012 | A | 7/1973 | Abelman | |
| 3,811,728 | A | 5/1974 | Redemske | |
| 3,874,729 | A | 4/1975 | Blodee | |
| 4,140,065 | A | 2/1979 | Chacon | |
| 4,523,787 | A | 6/1985 | Robinson | |
| 4,883,317 | A * | 11/1989 | Davenport | 297/188.1 |
| 4,919,480 | A | 4/1990 | Drew, III | |
| 4,919,485 | A | 4/1990 | Guichon | |
| 4,932,720 | A | 6/1990 | Sherman | |
| 5,069,506 | A | 12/1991 | Wieland | |
| 5,458,395 | A | 10/1995 | Skarda, Jr. | |
| 5,683,137 | A * | 11/1997 | McDonald et al. | 297/217.3 |
| 5,685,612 | A * | 11/1997 | MacDonald et al. | 297/378.1 |
| 5,692,335 | A | 12/1997 | Magnuson | |
| 5,718,475 | A * | 2/1998 | Watts | 297/127 |
| 5,727,844 | A | 3/1998 | O'Quinn et al. | |
| 5,938,281 | A | 8/1999 | Keils | |
| 6,241,317 | B1 * | 6/2001 | Wu | 297/440.23 |
| 6,390,551 | B1 | 5/2002 | Hendrickson | |
| 6,568,058 | B1 * | 5/2003 | Wieland et al. | 29/91.1 |
| 6,664,523 | B1 | 12/2003 | Kim et al. | |
| 6,715,837 | B2 * | 4/2004 | Niederman et al. | 297/440.14 |
| 7,028,859 | B2 * | 4/2006 | Moon et al. | 220/4.28 |
| 7,234,780 | B2 * | 6/2007 | Lipniarski | 297/461 |
| 2002/0140325 | A1 * | 10/2002 | Webster et al. | 312/223.1 |
| 2003/0080602 | A1 * | 5/2003 | Wu | 297/411.46 |
| 2006/0163917 | A1 * | 7/2006 | Schroeder et al. | 297/188.1 |
| 2006/0249998 | A1 * | 11/2006 | Westendorf et al. | 297/188.1 |
| 2006/0279124 | A1 * | 12/2006 | White et al. | 297/440.14 |
| 2008/0036256 | A1 * | 2/2008 | Gold et al. | 297/255 |

* cited by examiner

*Primary Examiner*—David Dunn
*Assistant Examiner*—James Alex
(74) *Attorney, Agent, or Firm*—McHale & Slavin, P.A.

(57) ABSTRACT

The present invention relates to kit for a patio bench utilizing injection molded plastic panels capable of being packaged and shipped in a knocked-down state and constructed into a secure patio bench. The patio bench may also include an integral storage box positioned beneath the bench seat. The panels utilized for assembling the patio bench are also constructed to allow a number of patio benches to be configured using common components.

17 Claims, 8 Drawing Sheets

SNAP-TOGETHER PATIO BENCH

FIELD OF THE INVENTION

This invention relates generally to a patio bench. More specifically, the present invention relates to a snap-together patio bench constructed of molded structural plastic panels to be capable of packaging and shipment in a knocked-down state for assembly at a desired site.

BACKGROUND INFORMATION

Modular furniture is known in the art, for example, U.S. Pat. No. 3,811,728 to Redemske discloses plastic modular furniture. The invention utilizes a plurality of plastic base modules having grooves formed on one face thereof. The base modules cooperate with various shells for sitting, sleeping, storage, and table tops. Each shell includes a perimetal edge for engaging the grooves on one of the base modules.

U.S. Pat. No. 4,140,065 to Chacon discloses a number of wooden panels to cover the entire areas of a back, a seat, or an end of a sofa or chair. The panels have tabs or hooks which fit into slots. Wedge shaped pegs are then used to secure the furniture components together.

U.S. Pat. Nos. 3,874,729 4,523,787, 4,932,720, 4,919,485 and 5,069,506 disclose various other embodiments of modular furniture.

Modular benches are also known in the art. For example, U.S. Pat. No. 4,919,480 to Drew discloses a sectional bench. The bench includes two A-shaped support members, a seat section and a plurality of slats secured to the A-shaped support members.

U.S. Pat. No. 3,748,012 to Abelman discloses a joining pedestal for benches assembled in a line. The pedestal has a lower post with a wide top to seat meeting end portions of adjoining bench seats. The end portions have setbacks to receive the shank of an upper pedestal portion. The upper pedestal extends rearwardly for attachment of a back portion. Before assembly of the pedestal, bench seat and back portion the joining areas are coated with an adhesive.

U.S. Pat. No. 5,938,281 to Keils discloses a seating structure for a child. The seating structure includes a box constructed of blow molded panels. The panels are connected at the ends with a pin that slides through apertures oriented transversely with respect to the panels. A bench seat is positioned within the box.

U.S. Pat. No. 3,463,546 to Geibel discloses a knockdown paperboard chair with a storage space. The paperboard chair is constructed from two blanks. One blank incorporates the back section and the side panels. Seat flaps are cut out from the side panels in such a way that the assembled chair resembles a swing chair and bottom flaps are interfolded together to form a base structure. A second blank forms a front section, a seat cover and a bottom flap.

Other U.S. Patents that disclose seats having storage areas positioned below the seat include U.S. Pat. Nos. 5,458,395, 5,692,335, 5,727,844, 6,390,551, 6,664,523.

Such prior art systems, while working well, have not met all of the needs of manufacturers to provide a product that can be easily manufactured, packaged and shipped or the needs of consumers requiring structural integrity combined with modularity, aesthetic appearance and ease of assembly.

Paramount among such needs is a panel system which creates a patio bench which resists panel separation, buckling, racking and weather infiltration. Security is a further consideration, the storage box formed by the panels must tie into the side panels and base panel in such a way as to unify the entire enclosure.

Also, from a versatility standpoint, a seat panel should be present which can be easily installed after assembly of the side and bottom components and which provides dependable security and pivoting access to the contents of the storage box.

There are also commercial considerations that must be satisfied by any viable patio bench system or kit; considerations which are not entirely satisfied by state of the art products. The patio bench must be formed of relatively few component parts that are inexpensive to manufacture by conventional techniques. The patio bench must also be capable of being packaged and shipped in a knocked-down state. In addition, the system must be modular and facilitate the creation of a family of patio benches that vary in appearance and functionality but which share common, interchangeable components.

Finally, there are ergonomic needs that a patio bench system must satisfy in order to achieve acceptance by the end user. The system must be easily and quickly assembled using minimal hardware and requiring a minimal number of tools. Further, the system must not require excessive strength to assemble or include heavy component parts. Moreover, the system must assemble together in such a way so as not to detract from the internal storage volume of the resulting storage box or otherwise negatively affect the utility of the patio bench.

BRIEF DESCRIPTION OF THE INVENTION

The present invention provides a system, or kit, of injection molded panels having integrated connectors which combine to form a patio bench. The panels are formed of injection molded plastic to interlock with one another without the need for separate fasteners or I-beam connectors. The system incorporates a minimum number of components to construct a patio bench by integrally forming the connectors into the injection molded panels. This minimizes the need for separate extruded or molded connectors to assemble the patio bench and facilitates snap-together assembly of the bench. The integrated connection of the side wall, seat and bottom panel components also provides for a storage box beneath the pivoting bench seat. The storage box is fully enclosed with wall panels to provide dry storage for items kept therein. Injection molding allows the panels to be formed with integral cross-bracing, ribs and gussets for increased rigidity while maintaining a lightweight construction that can be easily assembled and moved. The extra rigidity substantially prevents the panels from bowing inwardly and/or outwardly to resist panel racking and separation over time to maintain an aesthetically pleasing water resistant enclosure. The same side wall and bottom panel components are used to create a variety of patio benches, and the assembly of the patio benches require minimal hardware and a minimum number of hand tools.

The front and rear wall panels of the storage box have a combination of outwardly projecting locking posts and inwardly extending sockets for interlocking cooperative engagement with sockets and locking posts formed into the adjacent panels for locking the panels together in a substantially perpendicular relationship. The left and right end panels include integrally formed arm rests. In addition, the left and right end panels are constructed with inwardly extending contoured sockets for interlocking cooperative engagement with outwardly projecting locking posts on the ends of the front, rear and base panels. The engagement between the locking posts and the sockets serve to rigidly connect the components together without the need for additional fasteners. The back portion of the patio bench arm rests are formed hollow to accept a structural block which cooperates with the seat back, end panels and seat panel to provide additional rigidity and weight capacity to the assembled bench structure. The system further includes a seat panel which slides into place after the front, rear, side and bottom panels have been fully assembled. The seat panel is pivotally mounted to allow the storage compartment to be easily accessed, further increasing the utility of the patio bench. Integral formation of the connectors, via injection molding, permits connection to panels formed by other means such as blow molding and/or vacuum forming without the need for separate connectors. In this manner, a low cost yet structurally robust snap together patio bench can be constructed. Prior art assemblies that utilize extruded panels require separate connectors to attach the panels together, increasing the number of components and connections required to assemble a bench, thereby increasing the complexity and cost of assembly.

Accordingly, it is an objective of the present invention to provide a patio bench construction system wherein the patio bench components include integrated connectors for creating various patio benches which snap together using common components.

A further objective is to provide a patio bench with storage wherein the panels used for construction include integrated connectors accommodated by the process of injection molding.

Yet a further objective is to provide a bench assembly which includes a storage box wherein the side walls, cover, and bottom panel of the storage box are integrally interlocked without separate connectors or fasteners.

Another objective is to provide a bench assembly constructed of modular components having a pivotally mounted bench seat which provides access to an integral storage box.

Yet another objective is to provide a kit for a bench that is capable of being packaged and shipped in a knocked-down state and snapped together into a robust bench assembly.

Still yet another objective is to provide a combination of injection molded panels wherein connectors are integrally formed onto the edges thereof for connection to injection molded, extruded and/or blow molded panels to construct a bench assembly.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
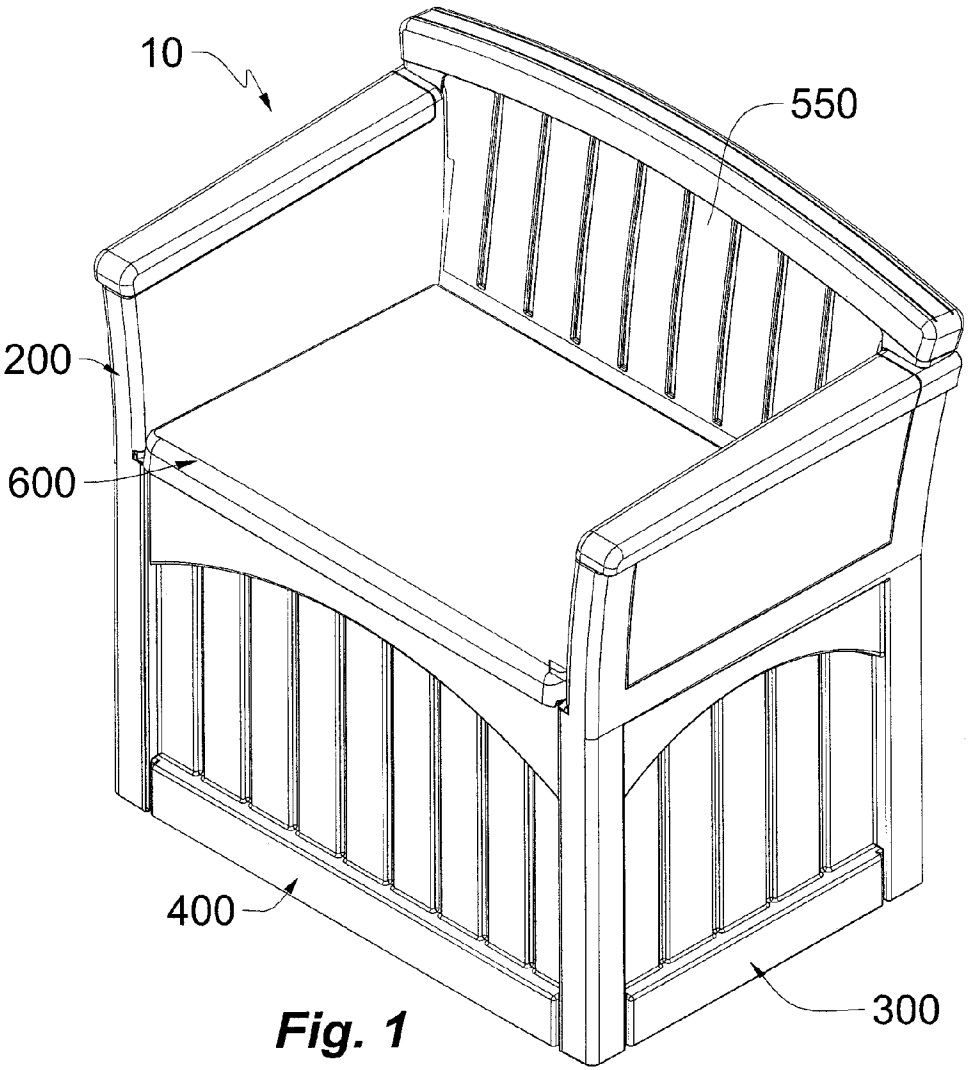
FIG. 1 is a top perspective view of one embodiment of the instant invention.
Figure 2:
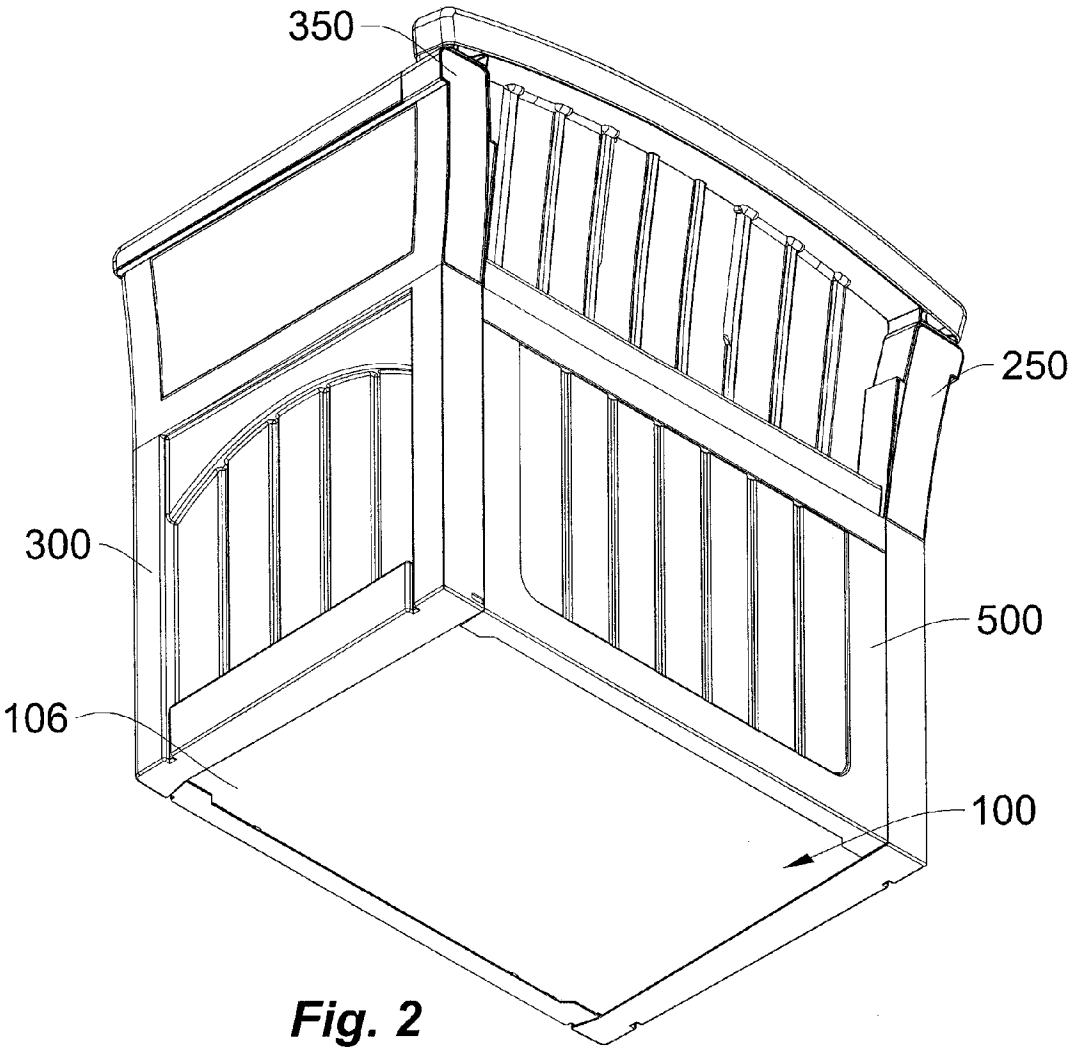
FIG. 2 is a bottom perspective view of one embodiment of the instant invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

FIGS. 1-10 which are now referenced illustrate perspective, exploded and sectioned views of the patio bench, generally referenced as 10, according to a preferred embodiment of the present invention. The patio bench is made up of a base panel 100, left side panel 200, right side panel 300, front panel 400, rear panel 500, backrest panel 550, and bench seat panel 600. In the preferred embodiment, the panels comprising the assembly are formed of, but not limited to, a suitable polymeric material such as plastic, through the process of injection molding. Injection molding offers significant versatility, strength and stability advantages over materials and processes as utilized in the prior art. The result is that the panels comprising the patio bench 10 are formed as single wall unitary panels with integral connectors, cross bracing, surface texture and the like. Strengthening ribs 202 and gussets 204 are formed within the inner surfaces of the panels in order to enhance rigidity of the panels while leaving the external surface in a generally smooth condition for aesthetic purposes. The ribs 202 and gussets 204 increase the structural integrity of the patio bench 10 by preventing the panels 200, 300, 400, 500 and 550 from bowing or bending inwardly or outwardly, and thus, adversely affecting the appearance or operation of the patio bench 10. In this manner the patio bench of the instant invention is capable of handling a significant amount of weight while providing a lightweight construction that can be shipped in a knocked down condition for snap-together assembly upon a desired site.

Referring to FIGS. 1-7, the front and rear panels 400 and 500 are each configured having a first end 408, 508 and a second end 412, 512, an upper end 414, 514 and a lower end 416, 516. Both the first and second ends include an integrally formed attachment means illustrated herein as an elongated post 410. The posts 410 are generally constructed and arranged to cooperate with the sockets 208 provided in either end of the left 200 and right panels 300. The lower ends 416, 516 of the front and rear panels include an integrally formed socket 115 constructed and arranged to cooperate with the base panel in an interlocking overlapping manner. Integrally formed spring clips 126 provide additional engagement between adjacent panels by snapping into an aperture or depression formed into the adjacent panel to prevent the panels from separating. The upper end 514 of the rear panel 500 is constructed and arranged to include a plurality of integrally formed posts 518, each post including an integrally formed spring lock 126 for engaging an aperture formed into the socket(s) 560 (FIG. 7) of the backrest panel 550. Also included on the upper end of the back panel 500 is a drip rail 520. The drip rail extends along the length of the rear panel and is preferably positioned below a lower surface of the bench seat panel 600. In this manner, water or moisture from the bench seat 600 and backrest 550 panels is channeled away from the storage box 522 (FIG. 10) formed by the assembled panels.

Still referring to FIGS. 1-7, a backrest panel 550 is illustrated. The backrest panel includes a top end 552, a bottom end 554, a left end 556 and a right end 558. Sockets 560 are integrally formed along the bottom end 554 for interlocking cooperation with posts 518 of the back panel. The top end 552 of the backrest panel includes a removable and replaceable backrest cover member 562. The backrest cover member includes an integrally formed socket 564 constructed and arranged to cooperate with a top end 552 of the backrest 550 in a snap-together arrangement. The backrest cover socket includes integrally formed spring locks 126 which cooperate with apertures 118 in the top end of the backrest panel. The left and right ends 556, 558 of the backrest panel include integrally formed posts 518 depending downwardly from the top end 552 for interlocking cooperation with the armrest portion 212 of the side panels 200, 300. In a most preferred embodiment, the locking posts include spring locks 126 to engage the side panel and/or structural blocks 250, 350 positioned in the armrest portion of the left and right side panels.

Referring to FIGS. 1-10, the patio bench includes a left side panel 200 and a right side panel 300 each having integrally formed legs 210 and armrests 212. The rear portion of the armrests 214 are formed hollow to accept a structural block 250, 350. Each structural block includes at least one integrally formed socket 560 for snap-together interlocking engagement with a left end or a right end respectively of the backrest panel. The structural block further includes a hinge pin aperture 566 constructed and arranged to cooperate with a hinge pin 602 formed to each distal end 604, 606 respectively of the bench seat panel. The hinge pin aperture 566 aligns with an aperture 260 formed into the inner wall of the armrest 212.

The left and right side panels 200, 300 include integrally formed sockets 208 for interlocking engagement with the front and the rear panels 400, 500 in a substantially perpendicular arrangement. In a most preferred embodiment, the armrests 212 include removable and replaceable armrest cover members 262. The armrest cover members are preferably formed hollow to include integrally formed connectors constructed and arranged to cooperate with an upper surface of each of the left and right armrest. The internal portion of the armrest covers include spring locks constructed and arranged to cooperate with apertures 118 for interlocking engagement between the armrest covers and the armrests.

Each of the left and right panels include a drip rail 264 secured along the length of an inner surface of each respective panel. The drip rails are positioned to be below a lower surface of the bench seat panel, whereby water contacting an upper surface of the bench seat panel is directed to at least one of the drip rails to be channeled away from an interior area of the storage box. The drip rails include integrally formed C-shaped spring locks 266 which are arranged to cooperate with elongated apertures 268 formed into the inner surface of the left and right side panels. For engagement the C-shaped spring locks are directed through the apertures 268 and thereafter the drip rail is slid rearwardly to engage the spring locks and interlock the drip rail to the respective side panel.

Referring to FIGS. 3, 4, 7 and 10, a bench seat panel 600 is illustrated. The bench seat panel includes an upper surface 608, a lower surface 610, a left end 604, a right end 606, a front end 612 and a rear end 614. A hinge pin 602 is integrally formed onto each of the left and right ends to allow the bench seat panel 600 to be pivotable about a central axis A of the hinge pins to enclose the top portion of the storage box and to provide ingress into and egress from the storage box 522. The front portion of the bench seat panel 600 includes an integrally formed latch member illustrated herein as a spring-catch 616 for releasably securing the cover in a closed position that is relatively parallel with respect to the ground surface. The spring-catch is constructed and arranged to cooperate with a catch plate 618 integrally formed to the front panel for releasable engagement between the bench seat panel 600 and the front panel 400, whereby the bench seat panel is releasable upon pulling upward on a front portion thereof. The lower surface includes integrally formed ribs 202 and gussets 204 to add rigidity and weight capacity to the seat panel.

Figure 3:
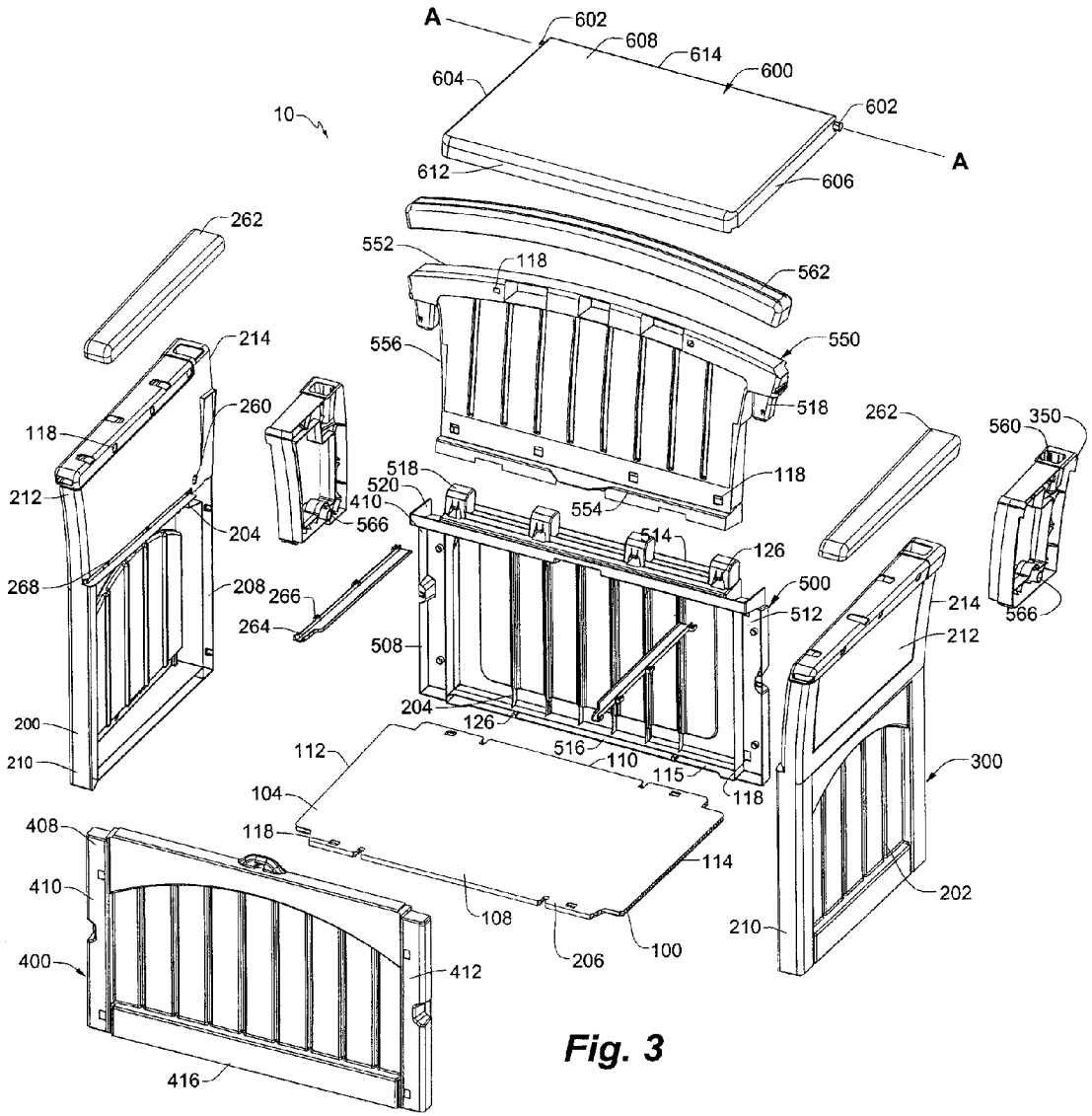
FIG. 3 is an exploded perspective view of the snap-together bench embodiment shown in FIG. 1.
Figure 4:
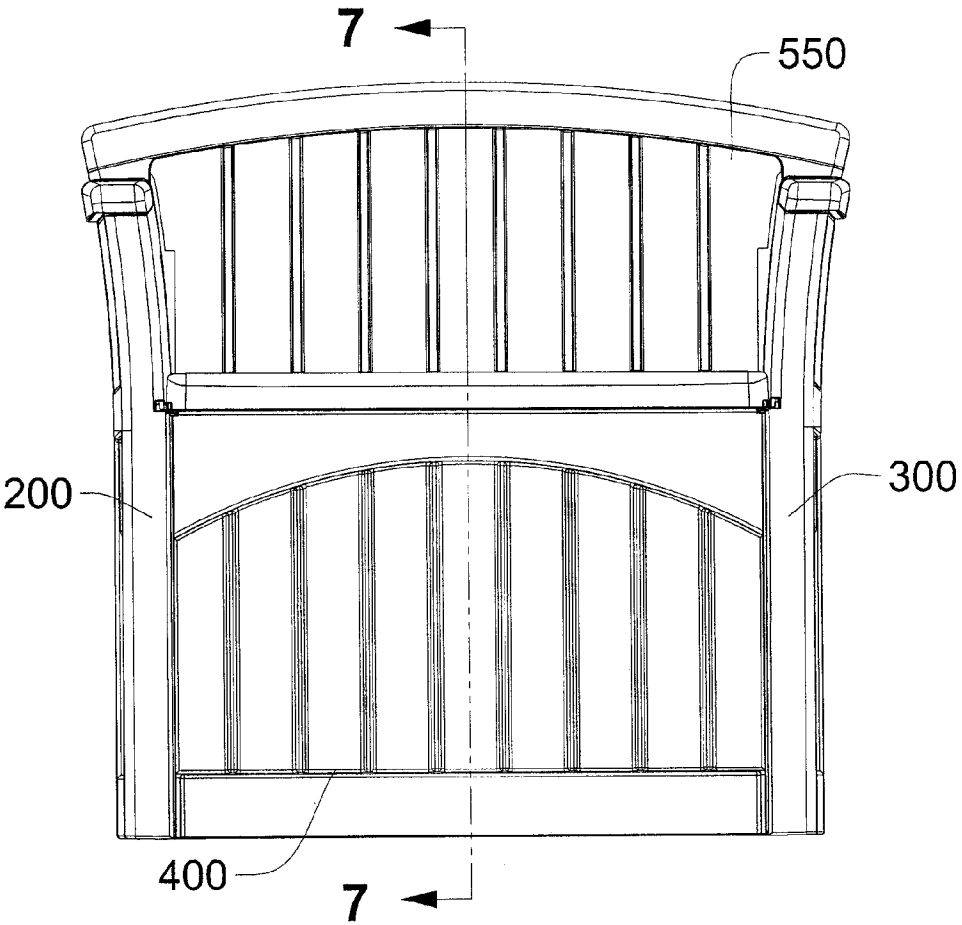
FIG. 4 is a front elevational view of one embodiment of the instant invention.
Figure 5:
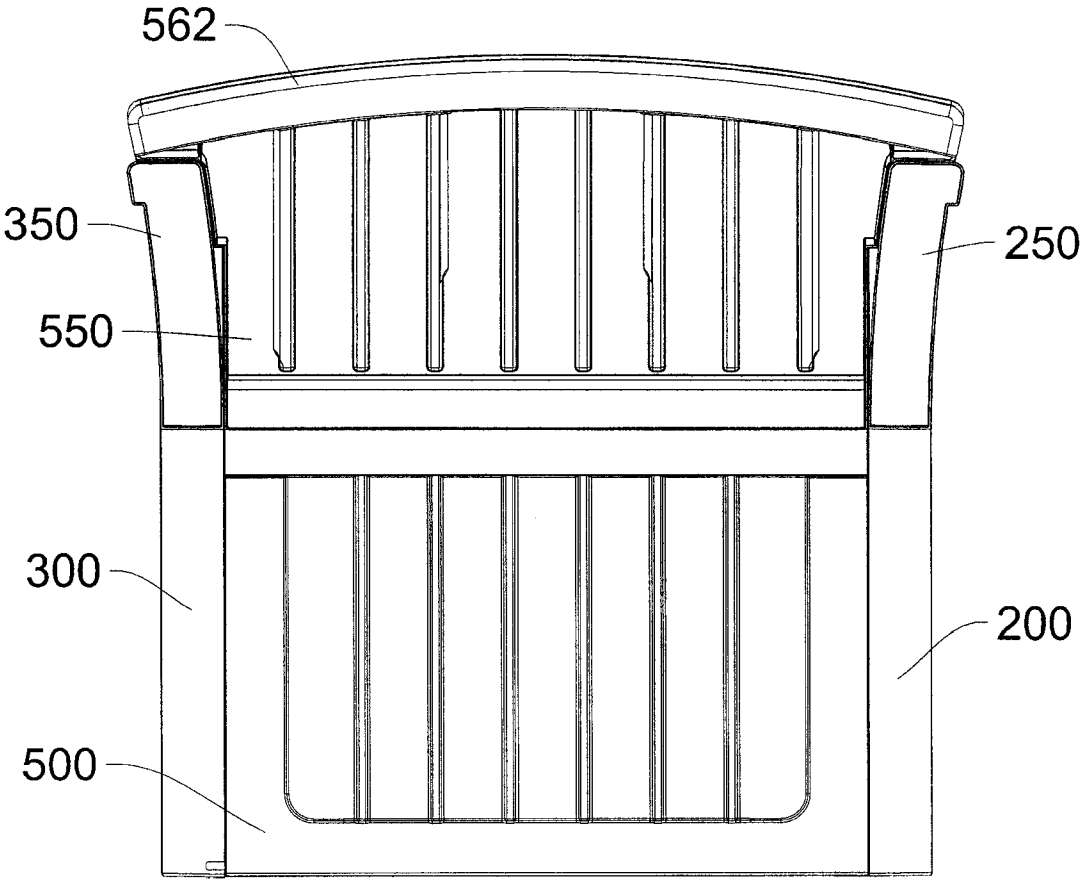
FIG. 5 is a rear elevational view of one embodiment of the instant invention.
Figure 7:
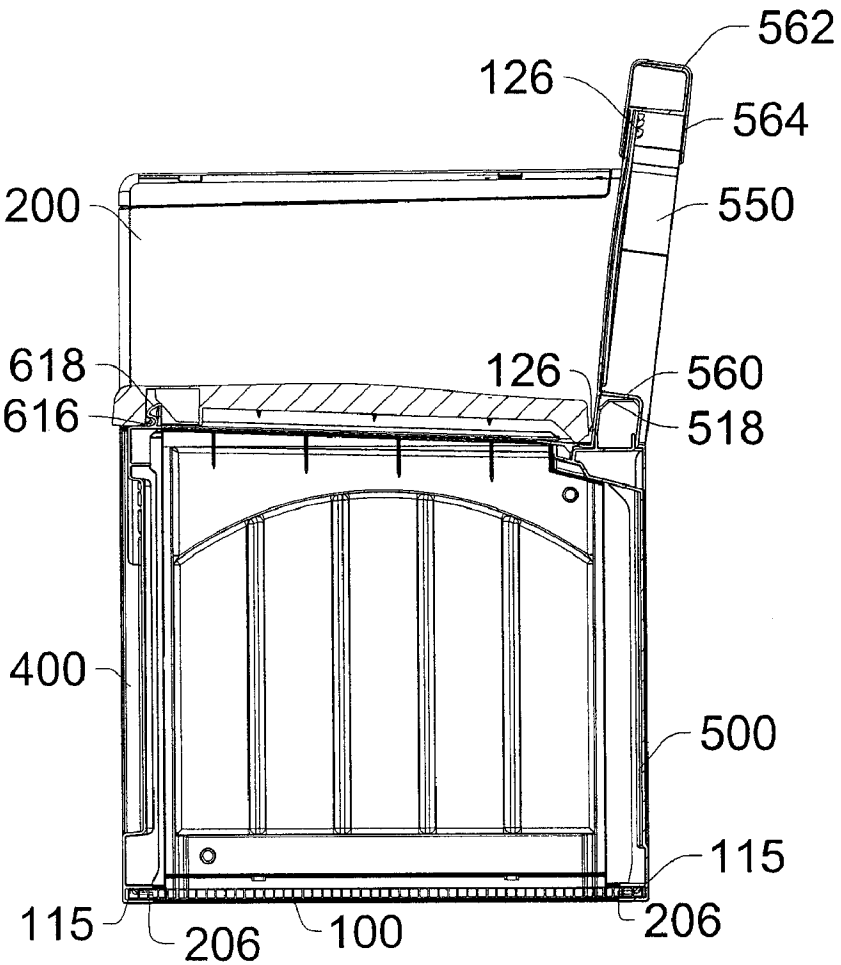
FIG. 7 is a section view along lines 7-7 of the bench embodiment shown in FIG. 4 illustrating the overlapping interlocking engagement between the panels constructing the bench assembly.
Figure 6:
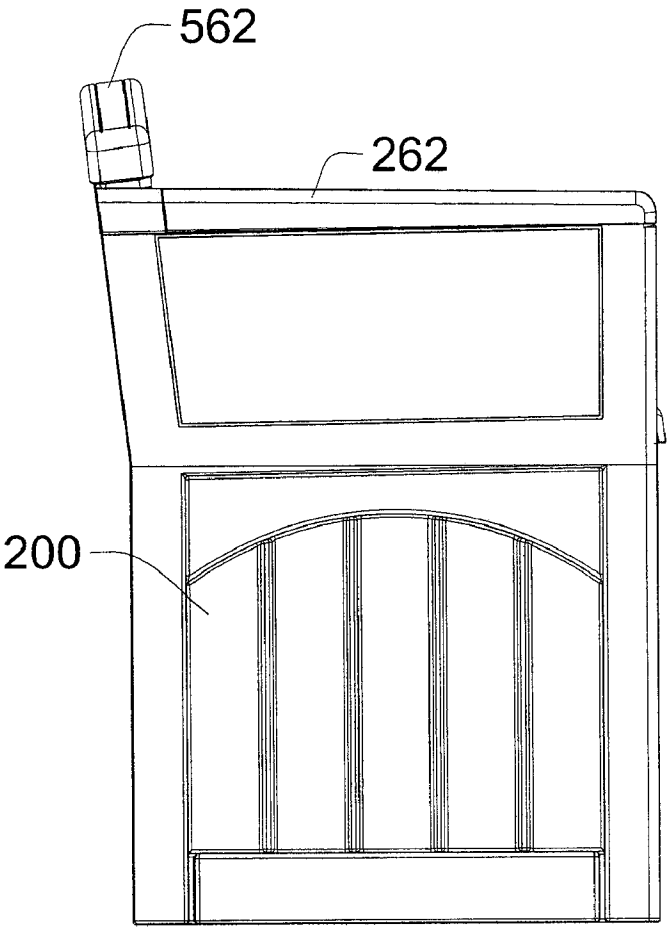
FIG. 6 is a side elevational view of one embodiment of the instant invention.
Figure 8:
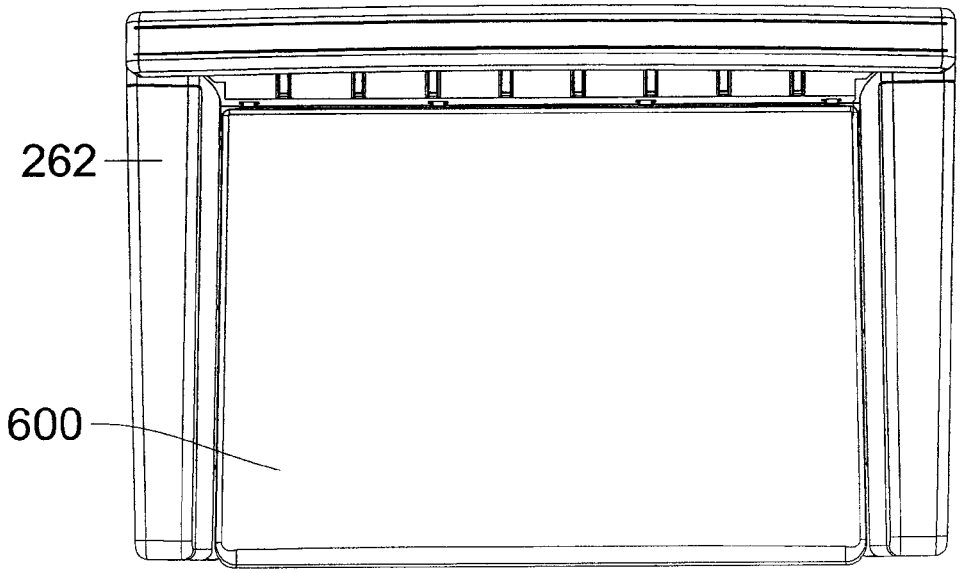
FIG. 8 is a top elevational view of one embodiment of the instant invention.
Figure 9:
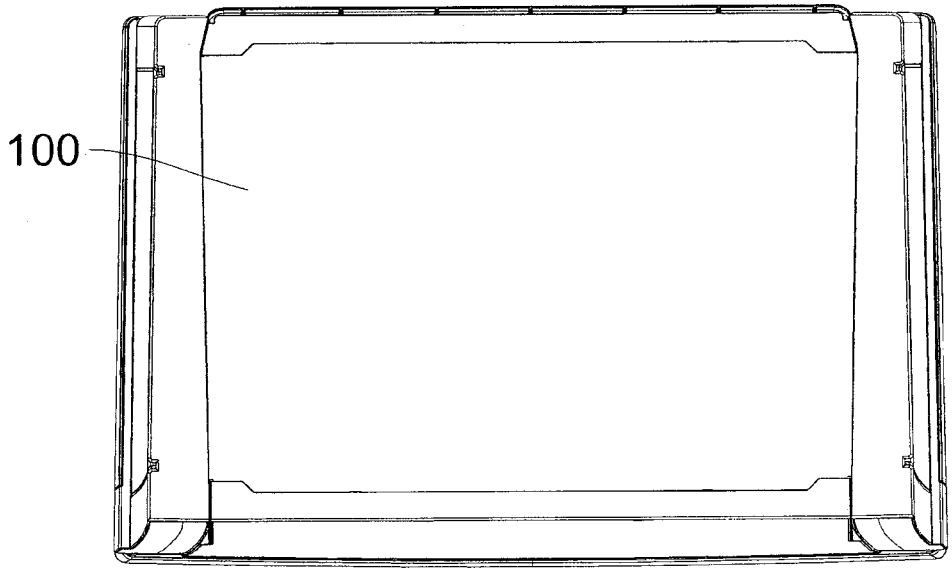
FIG. 9 is a bottom elevational view of one embodiment of the instant invention.
Figure 10:
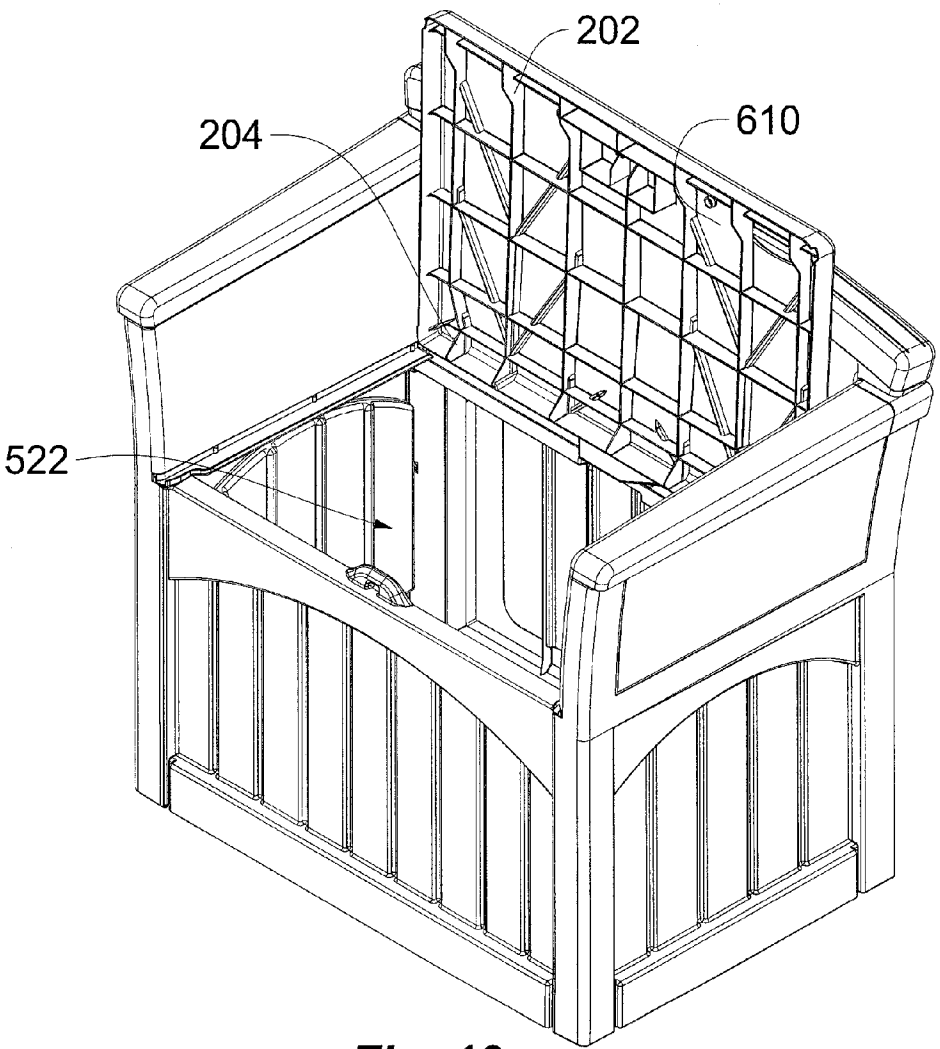
FIG. 10 is a top perspective view of one embodiment of the instant invention illustrating the bench seat in an open position to provide access to the storage box.

Referring to FIGS. 3 and 7, the base panel 100 has a top surface 104, bottom surface 106 (FIG. 2), like-constructed front and rear edges 108 and 110, and like-constructed left and right edges 112 and 114. Extending along the edges of the base panel are a plurality of posts 206. The posts are constructed and arranged to enter and mateably engage with sockets 115 formed along the lower portion of the left, right, front and rear panels in an overlapping interlocking fashion securing the panels together in a substantially perpendicular arrangement. The base panel also includes apertures 118 or indentations (not shown) for interlocking cooperation with spring locks 126 integrally formed into the sockets 115. It should be noted that while the base panel is preferably constructed through the process of injection molding, the base panel may be formed by other suitable methods which may include, but should not be limited to, blow molding, vacuum forming or compression molding without departing from the scope of the invention. The integrally formed connectors, e.g. the sockets, facilitate connecting the injection molded panels to panels formed by other methods without the need for separate connectors and/or fasteners.

It will be appreciated that the purpose of the posts 410, 518 and 206 are to align two panels in a substantially perpendicular or axially alined relationship and to facilitate their mechanical connection. The perpendicular panels are brought into an overlapping relationship wherein the posts enter the corresponding sockets 208, 560, 115. The result is a mechanically secure connection between the panels. The overlapping edges between the panels as described above provides a secure connection and offers several advantages. First, the design allows the panels to be connected without the need for separate connectors or fasteners. Second, the design creates a positive lock that prevents separation of the panels. Third, the design maintains alignment of the panels in the same plane and prevents bowing or bending of either panel relative to one another. The resultant patio bench created by the combination of the interlocking panels benefits from high structural integrity and reliable operation.

It should be noted that the positions of the posts and sockets on respective panels can be reversed without departing from the scope of the invention. It should also be noted that while the posts and sockets are illustrated as having a substantially rectangular shape, both the posts and sockets may be configured in any shape and/or combination of shapes suitable for interlocking engagement between the adjacent panels; such shapes may include, but should not be limited to, polygons, cylinders, ovals, D-shapes and the like.

Referring generally to the FIGS., the front and rear panels 400, 500 are attached to the base panel 100 by sliding the locking posts 206 along the edges 108, 110 into the corresponding sockets 115. The sockets 115 in the bottom portion of the front and rear panels correspond in shape and size to that of the locking posts 206, and spring tabs 126 integrally formed into the sockets 115 align with apertures 118 in the locking posts 206 to engage the front and rear panels 400 and 500. The result is a positive mechanical connection between the front and rear panels 400, 500, and the base panel 100.

The left and right side panels 200, 300 are attached to the front, rear, and base panels 400, 500, 100 by inserting the posts 410, 206 into contoured sockets 208, 115 until the spring tabs 126 integrally formed into the sockets engage the apertures 118 in the posts. The result is a positive mechanical connection between the left and right panels 200, 300, and the front 400, back 500 and base panel 100.

The backrest panel 550 is secured to the left, right and back panels 200, 300, 500 by sliding the socket 560 over posts 518 while simultaneously inserting posts 518 into sockets 560 in the upper portion of the armrest until the spring locks 126 engage the apertures 118. The result is a positive mechanical connection between the backrest panel 550, the back panel 500, the left panel 200, the right panel 300 and the structural blocks 250, 350.

The bench seat panel 600 is secured to the left and right panels by placing one of the hinge pins 602 into a respective aperture 260 of an armrest to engage the structural block aperture 566. Thereafter the opposite end of the bench seat panel is slid downwardly until the other hinge pin engages the apertures in the side panel and structural block at the other end of the bench.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A patio bench kit comprising:

a left side panel, said left side panel including integrally formed posts or sockets for interlocking engagement with a front and a rear panel in a substantially perpendicular arrangement, said left side panel including an armrest with a hollow armrest portion;

a right side panel, said right side panel including integrally formed posts or sockets for interlocking engagement with a front and a rear panel in a substantially perpendicular arrangement, said right side panel including an armrest with a hollow arm rest portion;

a rear panel having integrally formed posts or sockets positioned for snap-together interlocking engagement with corresponding said posts or sockets of said left and said right side panels, whereby said panels are secured together in a substantially perpendicular arrangement, a front panel having integrally formed posts or sockets positioned for snap-together interlocking engagement with corresponding said posts or sockets of said left and said right side panels;

a bench seat panel having integrally formed connectors constructed and arranged for snap-together interlocking engagement to at least two of said left, right, front or back panels in a substantially parallel arrangement with respect to a ground surface;

a backrest panel, said backrest panel including integrally formed posts or sockets for interlocking snap-together interlocking engagement with corresponding posts or sockets formed on said rear panel;

a pair of structural block members each sized and shaped for insertion into said hollow portion of each said armrest, each said structural block member constructed and arranged to be secured to a respective side panel and said backrest panel, thereby structurally interlocking said side panels and said backrest panel together.

2. The patio bench kit of claim 1 wherein each said structural block includes at least one integrally formed post or socket for snap-together interlocking engagement with a corresponding post or socket formed on said left or said right armrest respectively, each said structural block further including at least one integrally formed post or socket for snap-together interlocking engagement with a corresponding post or socket formed on a left end or a right end respectively of a backrest panel.

3. The patio bench kit of claim 2 wherein each said socket includes at least four sidewalls, said sidewalls constructed and arranged to provide longitudinal and transverse support to a post interlocked therewith to provide a positive lock that prevents separation of the panels.

4. The patio bench kit of claim 2 wherein said structural block further includes a hinge pin aperture constructed and arranged to cooperate with a hinge pin secured to each distal end of said bench seat panel, whereby said hinge pins and said bench seat panel are pivotable about a central axis of said hinge pins.

5. The patio bench kit of claim 1 wherein said patio bench includes a storage box positioned directly below said bench seat panel, wherein said storage box includes a base panel secured between said left, right, front and rear panels, wherein said bench seat panel includes a hinge pin secured to each distal end thereof, whereby said bench seat panel is pivotable about a central axis of said hinge pins to enclose the top portion of said storage box and to provide ingress into and egress from said storage box.

6. The patio bench kit of claim 5 wherein said base panel is formed by the process of injection molding.

7. The patio bench kit of claim 5 wherein said base panel is formed by the process of extrusion.

8. The patio bench kit of claim 5 wherein said left, right and rear panels each include a drip rail secured along the length of each respective panel, said drip rails positioned below a lower surface of said bench seat panel, whereby water contacting an upper surface of said bench seat panel is directed to at least one of said drip rails and to be channeled away from an interior area of said storage box.

9. The patio bench kit of claim 5 wherein a front portion of said bench seat member includes an integrally formed latch member, said latch member being constructed and arranged to cooperate with an upper portion of said front panel for releasable engagement between said bench seat panel and said front panel, whereby said bench seat panel is releasable upon pulling upward on a front portion of said panel.

10. The patio bench kit of claim 9 wherein said front portion of said bench seat panel includes at least one spring-lock for releasably securing said bench seat panel, said spring-lock constructed and arranged to cooperate with a catch plate integrally formed to said front panel.

11. The patio bench kit of claim 1 wherein said integrally formed armrests include removable and replaceable arm rest cover members, said arm rest cover members including integrally formed connectors constructed and arranged to cooperate with an upper surface of each said left and said right armrest.

12. The patio bench kit of claim 5 wherein a bottom surface of said base panel includes integrally formed cross-bracing; wherein said cross-bracing provides increased weight capacity and stability to said storage box.

13. The patio bench kit of claim 1 wherein said front panel and said rear panel each include at least one integrally formed post extending outwardly from each distal end thereof, said post constructed and arranged to cooperate in an interlocking overlapping fashion with at least one socket integrally formed into each distal end of said left and said right side panels resulting in a mechanically secure connection between said left, right, front and rear panels.

14. The patio bench kit of claim 1 wherein said left, right, front and rear panels are formed from a polymeric material by the process of injection molding.

15. The patio bench kit of claim 14 wherein said polymeric material is plastic.

16. The patio bench kit of claim 1 wherein each said post includes at least one spring lock, said at least one spring lock constructed and arranged snap into a depression formed into an adjacent panel to prevent separation thereof.

17. The patio bench kit of claim 1 wherein each said socket includes at least one spring lock, said at least one spring lock constructed and arranged snap into a depression formed into an adjacent panel to prevent separation thereof.

* * * * *